United States Patent [19]

Canalizo

[11] Patent Number: 4,653,128

[45] Date of Patent: Mar. 31, 1987

[54] MODULAR BATHROOM UNIT

[76] Inventor: Francisco Canalizo, Fuente de los Leones 7, Tecamachalco, Edo. de Mex., Mexico

[21] Appl. No.: 795,058

[22] Filed: Nov. 5, 1985

[51] Int. Cl.[4] ..... A47K 4/00; E03C 1/01

[52] U.S. Cl. ..... 4/663; 4/192; 4/664; 4/665

[58] Field of Search ..... 4/661, 665, 663, 664, 4/596, 605, 191, 192

[56] References Cited

U.S. PATENT DOCUMENTS

| | | | |
|---|---|---|---|
| 1,868,760 | 7/1932 | Norberg | 4/665 |
| 2,198,605 | 4/1940 | Faber | 4/665 X |
| 2,860,348 | 11/1958 | McClanahan | 4/665 |
| 3,588,922 | 6/1971 | Carfora | 4/665 |
| 3,696,448 | 10/1972 | Carfora | 4/665 |
| 4,197,597 | 4/1980 | Toms | 4/665 X |
| 4,358,864 | 11/1982 | Medrano | 4/665 |
| 4,377,875 | 3/1983 | Brubakken | 4/665 |

*Primary Examiner*—Henry K. Artis
*Attorney, Agent, or Firm*—Pennie & Edmonds

[57] ABSTRACT

A modular bathroom unit is described, coming in a single cabinet, in which an hydraulic system, a drainage system and the system of regulation of different fixtures are integrated, and consisting of a least one equipped washbasin, one toilet with cover and one shower.

8 Claims, 6 Drawing Figures

MODULAR BATHROOM UNIT

BACKGROUND OF THE INVENTION

1. Field of the Invention:

The invention relates to the fields of water conservation and building construction. In particular the invention relates to a modular bathroom designed for efficient use of water.

2. Background:

At present, a major world problem is the scarcity of potable water, which is constantly becoming worse and worse, due mainly to high world population growth.

The water drunk by the majority of communities and municipalities is obtained from surface sources, rivers, streams and lakes. This type of natural source, particularly, stream or rivers, is polluted with some household and industrial wastes, like sewage. Many inhabitants of cities are not worried by the fact that a large part of the water they consume comes from rivers or sources that have previously had household or industrial uses. Municipal purification systems have been improved to protect the inhabitants against water pollution. At the same time, because of the growth of communities, pollution problems have become more acute. More and more water is needed and that being used has to be disposed of, generally returning it to a natural reservoir, which in turn is the source of supply of another community. Since water is a carrier of pathogenic microorganisms, it can endanger health and life.

In addition to the native microorganisms of water, there can also be microorganisms originating from air pollution, the soil or human or animal excretions.

Among the microbes capable of transmitting diseases, *Bacillus anthracis,* causative agent of anthrax or carbuncle, fatal to cattle, is found in the air and in the soil, and there can be pathogens like *Clostridium tetani,* the agent of botulism, in the soil. Furthermore, in the stools of people and animals, which contaminate water directly or indirectly, in general, there is a large variety of genera and species of microorganisms like: species of bacteria of the Salmonella genera, producing typhoid and paratyphoid infections; Shigella, causative agent of bacillary dysentery; Leptospira, which produces leptospirosis; Brucella, agent of Malta fever; Mycobacterium, which causes tuberculosis, and *Vibrio comma,* the cause of cholera. Among the viruses are those of infectious hepatitis, poliomyelitis or infantile paralysis and others that can cause intestinal and respiratory diseases. Finally, among the Protozoa, *Endamoeba histolytica* or agent of amebiasis is one of those most frequently encountered and, for example, in Mexico nearly 27% of the population was suffering from this disease in 1977.

Among the microorganisms contaminating potable water, which are not a direct cause of diseases, but rather of problems, are those that create unpleasant odors, colors and tastes, as well as the precipitation of insoluble compounds in pipes, which reduce or obstruct the flow of water.

Furthermore, another problem has arisen, which affects both developed and underdeveloped countries in their policies as well as in their economies, namely, major crop losses due to the shortage of water for irrigation. For example, in one great city, the Federal District, which has several million inhabitants and in which the shortage of water is a very serious and alarming problem, it has reached the point where water, an element fundamental to life, has had to be rationed most of the time. In such cases the communities affected are sometimes supplied with just a few liters of water in barrels. Other times not a single liter of water is supplied. While in other communities water is supplied in large quantities and is squandered by leaving taps open for 24 hours a day, by leaks, watering of large gardens, systems of toilets in poor conditions, faulty mains, car washes, etc.

At present, the bathrooms of residential houses, hotels, sports facilities, etc., are furnished with showers, washbasins and toilets, each independently installed, so that large quantities of water are required for their operation. In addition, they now have very high cost. The water and drainage systems of each shower, toilet and washbasin also require a large quantity of pipe, which is expensive at present and, when added to the cost of the washbasin, shower, toilet, etc., as well as of the fixtures of same, is stratospherically high.

At present, public housing, condominiums, etc., include a very small area for the bathroom, so that when the shower, toilet and washbasin are installed separately, almost the entire area earmarked for the bathroom is occupied by these items. Aside from being very inconvenient for the users, this type of installation looks very bad and presents major repair problems.

Considering each and every one of the aforementioned problems and others not mentioned, I have carried out innumerable studies and experiments, which led to a truly novel design for a modular bathroom unit that is very economical, looks very good and is very easy to install anywhere. It occupies a very small area, and partly solves the problems mentioned in the foregoing paragraphs. The water used in the shower as well as in the washbasin is simply recirculated directly to a tank of a toilet for use again, which saves large quantities of water, this being vital at the present time.

SUMMARY OF THE INVENTION

The modular bathroom unit of this invention contains an hydraulic system and a drainage system in a single cabinet and consists of:

A faucet unit, glass rack and toothbrush holder.

A washbasin with soap dish, drain and drain plug.

A toilet (commode) with cover.

A tank for water from the washbasin and for flushing the toilet, equipped with check and shutoff valves for optimization of reusable water.

A toilet tank drain valve, with drain, float and mechanical system for operating the valve.

A cabinet base and cover, containing the faucet unit, washbasin, toilet, water tank, hydraulic system, drainage system, shower drain and basin drain, equipped with towel rack, toilet-paper holder, opening cover and grate for access to drainage system.

The modular bathroom unit of the invention has certain advantages; for example, the modular bathroom unit of this invention consists of a single cabinet and contains only one hydraulic system and one drainage system. This minimizes the systems of connections, since it includes:

One connection for cold water.

One connection for hot water.

One connection for drainage, in order to serve the whole system of the modular bathroom unit and its attached units. The modular bathroom unit minimizes installation costs, and optimizes the hydraulics of the system by using only four cocks, which make it possible:

(A) To have cold and/or hot and/or mixed water by operating only one cock for the washbasin.

(B) To have cold and/or hot and/or mixed water by operating only one cock for the shower.

The modular bathroom unit makes possible the optimization and rationalization of water use by reutilizing the soapy and/or clean water coming from the washbasin and shower for use in the toilet. Further, the modular bathroom unit makes further provision for finishing the floor, so it will be flush with the base of the modular cabinet. Provision is made in the unit for the installation of a washing machine after adjustment of a fitting.

The modular bathroom unit provides a water tank divided by a wall or partition into two sections, which have the following objectives:

The first section of the tank is intended to trap the water coming from the washbasin drain and/or from the water chamber of the shower until it reaches a fill limit sufficient for the volume of water trapped to create the drainage effect in the toilet. This section of the tank is directly connected to the water inlet of the toilet.

The second section has the following functions:

(A) To trap all of the water that overflows on overfilling the first section of the tank.

(B) When the first section of the tank is emptied, it will be automatically refilled with the water that has been deposited in the second section of the tank. For this purpose a shutoff valve that operates by pressure difference is connected between the two sections. This check valve in turn prevents the water being accumulated in the first section of the tank from seeping into the second section of the tank, thus enabling the connecting vessel effect to occur only from the second section of the tank to the first and not in the opposite direction.

The design of the container of water coming from the shower provides for reuse of the water, since the latter will be kept in a chamber before being emptied into the drain. This container provides a system of water return to the tank of the modular cabinet.

The modular bathroom unit of the invention in integrated form will be useful for complete bathroom installation in residential houses, horizontal or vertical condominiums, hotels, sports facilities and every type of structure requiring a bathroom. Its use may likewise be earmarked for mobile units.

The modular bathroom unit can be used simultaneously or separately as:

a washbasin (cold or hot or mixed water);

a shower for bathing the whole body (cold or hot or mixed water);

a toilet;

a water tank; or for a washing machine.

The modular bathroom unit of the invention provides the following accesses for maintenance, repair or extraction of lost objects:

The washbasin is designed to be liftable, turning on pins, which makes it possible at any time to have direct access to the hydraulic system and thereby carry out a repair or else recover objects that have passed into the water tank. The cabinet is designed for direct access to the drainage system and hydraulic system by three sections, which will make possible repairs and/or major overhaul at any given moment.

DESCRIPTION OF THE PREFERRED EMBODIMENT

Making reference to the figures in which is shown the preferred embodiment of the modular bathroom unit of the invention, there is a single cabinet I encasing the following components:

A hydraulic system RH illustrated completely in FIG. 6 and described below;

A drainage system RD illustrated in FIG. 5 and also described below; and

The system of regulation of different fixtures.

Figure 1:
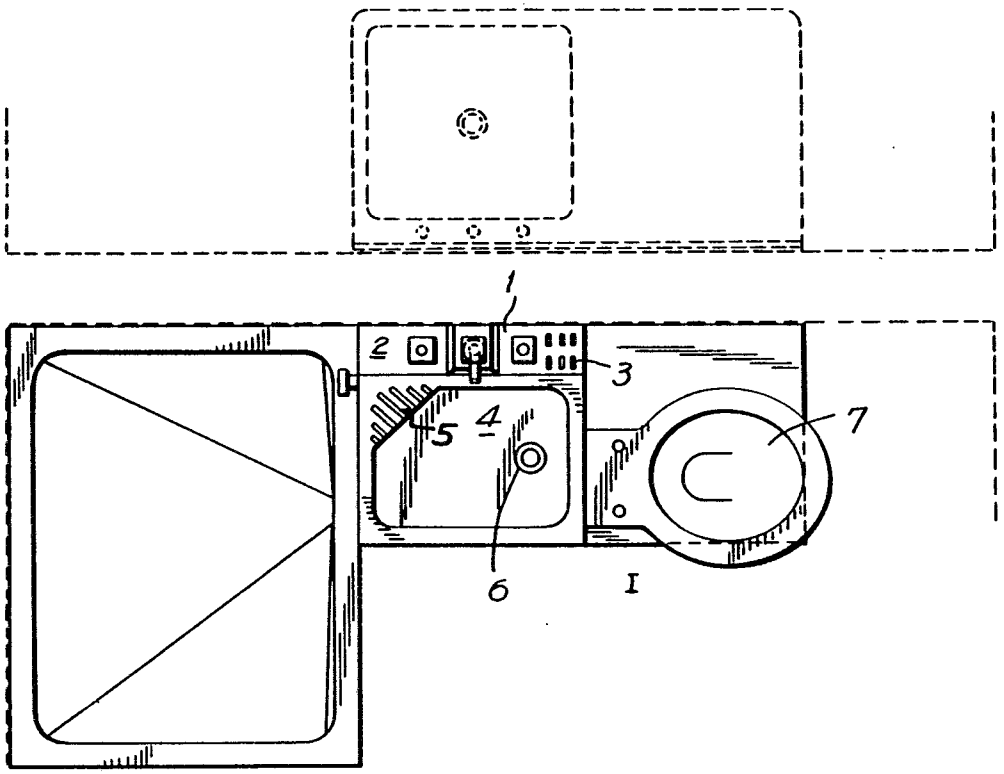
FIG. 1 is a top plan view of the modular bathroom unit of this invention.

The cabinet of the modular bathroom unit to which the invention pertains is illustrated in FIG. 1. The unit includes a faucet unit 1, a glass holder 2, a toothbrush holder 3, a washbasin 4 with a soap dish 5, a drain 6 with a plug (not shown), a toilet 7 (commode) with a cover (not shown), a tank 8 (illustrated in FIG. 2) for water coming from the washbasin 4 and for flushing the toilet 7. The fixtures with which the tank 8 is equipped are illustrated in FIG. 3 which include a partition 9 and a shutoff valve 10 for optimization of reusable water; a drainage valve 11 of the tank 8 for the toilet 7 which has a drain (not shown), a float and a mechanical system (not shown) for operating the valve 11; a base 12 and a cover 13 for the cabinet I, containing the faucet unit 1, the washbasin 4, the toilet 7, the water tank 8, the hydraulic system (FIG. 6), a drainage system (FIG. 5) and a shower drain illustrated in FIG. 5, equipped with a towel rack, a toilet-paper holder with cover (not shown), and an inspection grate 14 for access to the drainage system.

Figure 3:
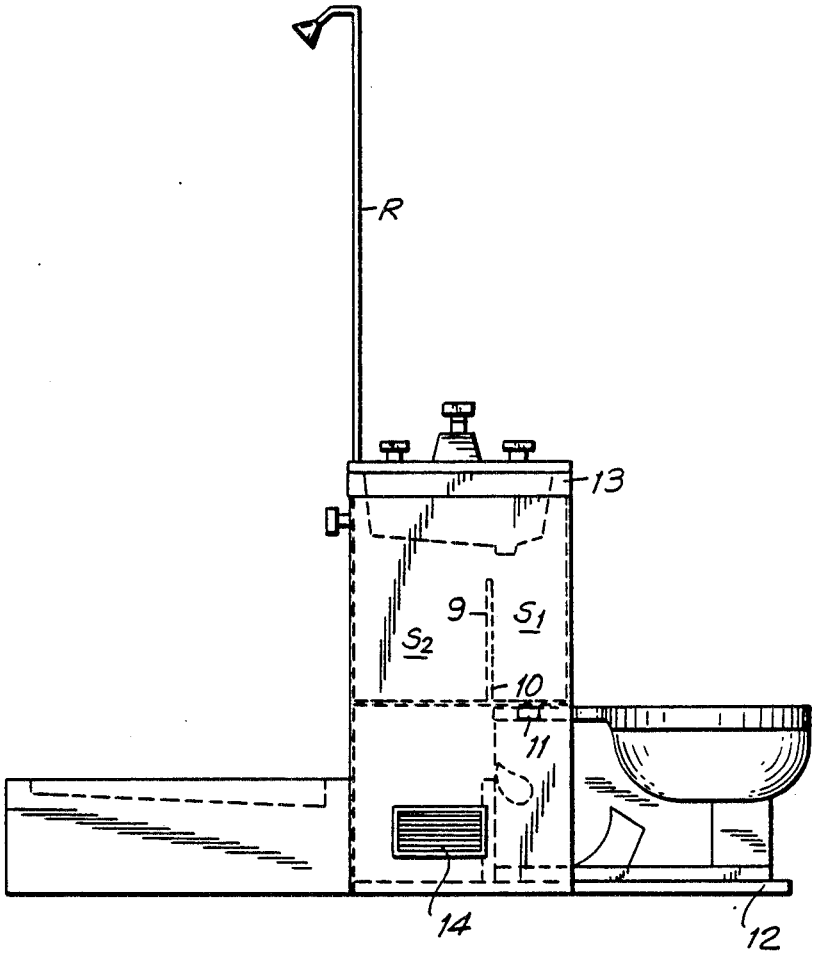
FIG. 3 is a side elevation view of same.
Figure 5:
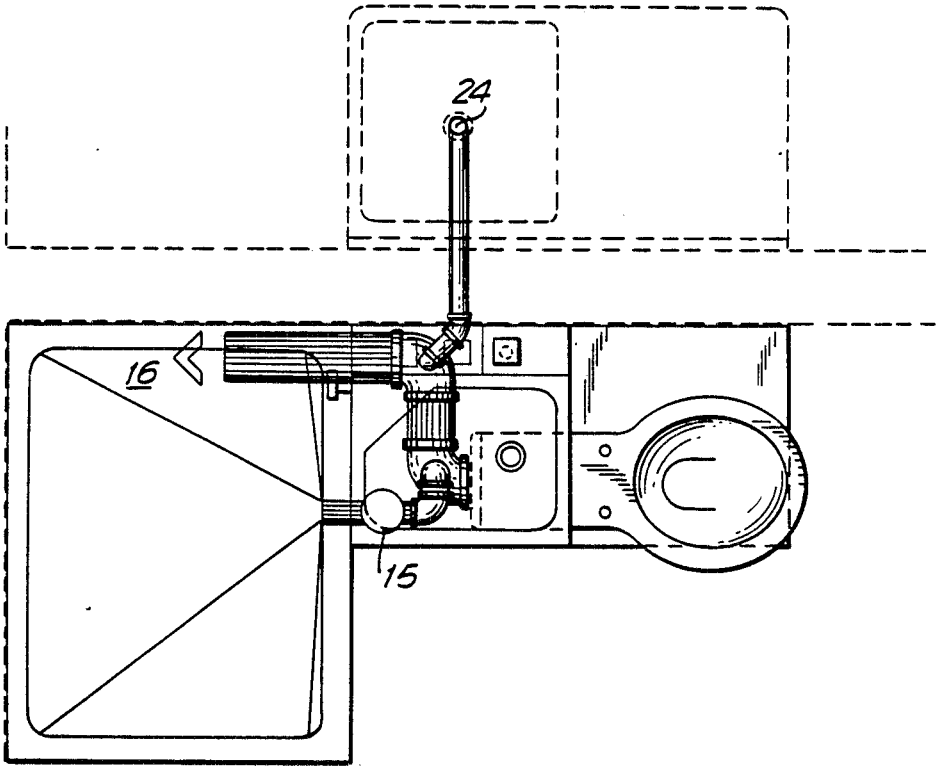
FIG. 5 is a plan view of the plumbing or drainage system.

FIG. 5 illustrates the drainage system which includes: an S-shaped system integrated with the cabinet I for entrapment of waters (sewage and/or soapy and/or greasy and/or clean) coming from the toilet 7 and/or a shower R illustrated in FIG. 3, and/or another cabinet, such as a sink or a washing machine, etc., an entrapment system SC for water coming from the shower R, with a cesspool 15 (water seal); a system of double ventilation to the drainage system, an access for unplugging drainage (not shown), and a single outlet connection 16 for the drainage system.

A regulating system of the following components is shown for the modular bathroom unit of this invention, using the same hydraulic system and drainage system across the wall, which are as follows: a shower base or container 17, illustrated in FIG. 4, equipped with a water chamber (not shown) for reutilization of the water, with a system of return of soapy waters to the water tank of the cabinet I; a sink or other household appliance requiring cold and/or hot water and drainage across the wall.

Figure 6:
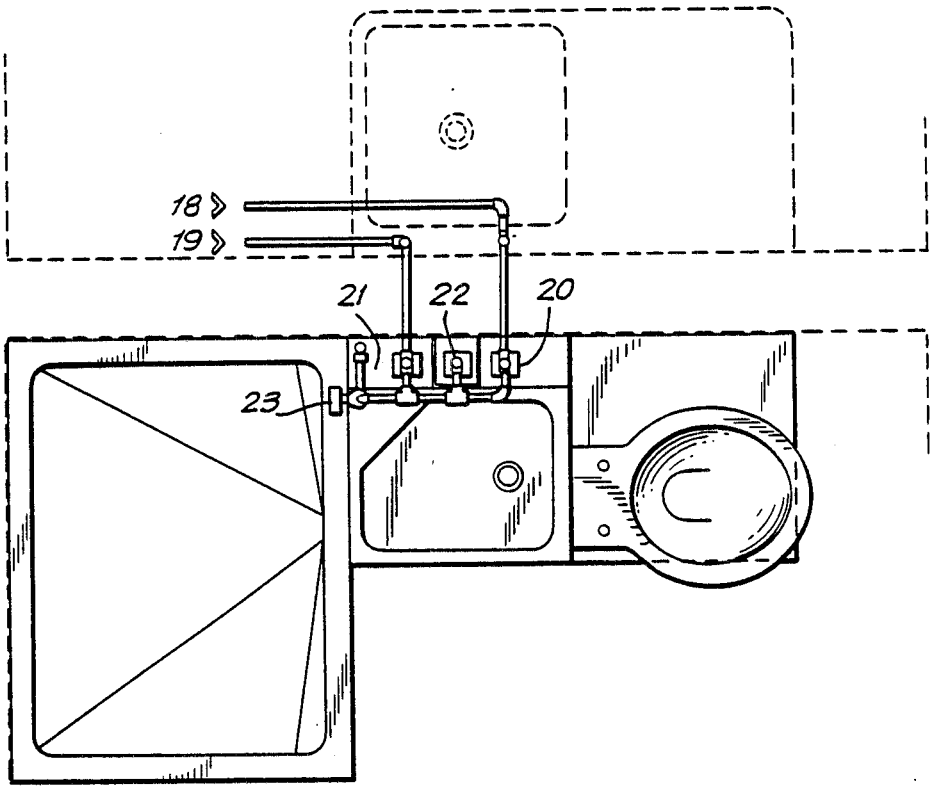
FIG. 6 is a plan view of the hydraulic system, showing the cold water and hot water connections.

Reference is now made to FIG. 6 showing the hydraulic system which includes a single inlet connection 18 for supply and distribution of cold water to the system; a single inlet connection 19 for supply and distribution of hot water to the system; a cold water inlet control cock 20; a hot water inlet control cock 21; a cock 22 with water outlet (cold or hot or mixed) to the washbasin, a cock 23 for control of water outlet (cold or hot or mixed) to the shower; and a shower R.

Figure 2:
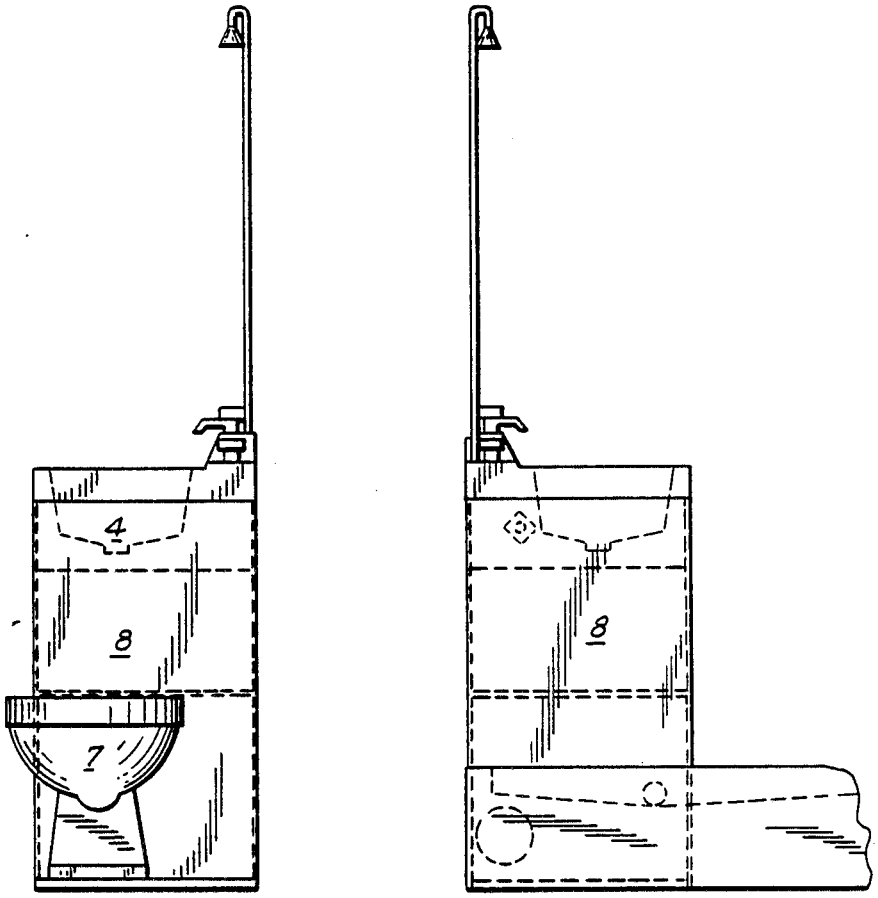
FIG. 2 is a front elevation view of same.

It is evident from FIG. 2 that the modular bath unit of this invention makes possible the optimization and rationalization of water usage utilizing soapy and/or clean water coming from the washbasin 4 and the shower R for the toilet 7 through the use of tank 8.

It is seen in FIG. 3 that provision is made for laying a floor flush with the base 12 of the modular cabinet I and for the installation of a washing machine after adjustment of a fitting for drainage like drain 24. A water tank 8 is provided, divided by a wall or partition 9 into a first and second sections $S_1$ and $S_2$, which have the following objectives: the first section $S_1$ of the tank 8 is intended to trap the water coming from the drain of the washbasin 4 and/or from the water chamber 17 of the shower R until reaching a fill limit sufficient for the volume of water trapped to create the drainage effect in the toilet 7. This first section $S_1$ is directly connected to a water inlet of the toilet 7.

The second section $S_2$ of the tan serves trap all the water from the drain on overfilling of the first section $S_1$ of the tank. Then, when the first section $S_1$ of the tank 8 is emptied, it will be automatically filled with the water that has been deposited in the second section $S_2$ of the tank 8. To this effect this filling function the valve 10, operating by pressure difference, is used. The check valve 10 in turn prevents the water being accumulated in the first section $S_1$ of the tank 8 from seeping into the second section $S_2$ of the tank. Thus the vessels are connected only in the direction from second section $S_2$ of the tank 8 to the first section $S_1$ of the tank 8 and not in the opposite direction.

The base or container 17 of water coming from the shower R makes provision for the reuse of the water. Water is kept in the chamber for reuse before being emptied into the drain. Furthermore, the container 17 provides for a system of water return to the tank 8 of the modular cabinet I.

The integrated uses of the modular bathroom unit of this invention maybe used for a complete bathroom in residential dwellings, horizontal and/or vertical condominiums, hotels, sports facilities and any type of structure requiring a bathroom; its use may likewise be earmarked for mobile units of any type.

Figure 4:
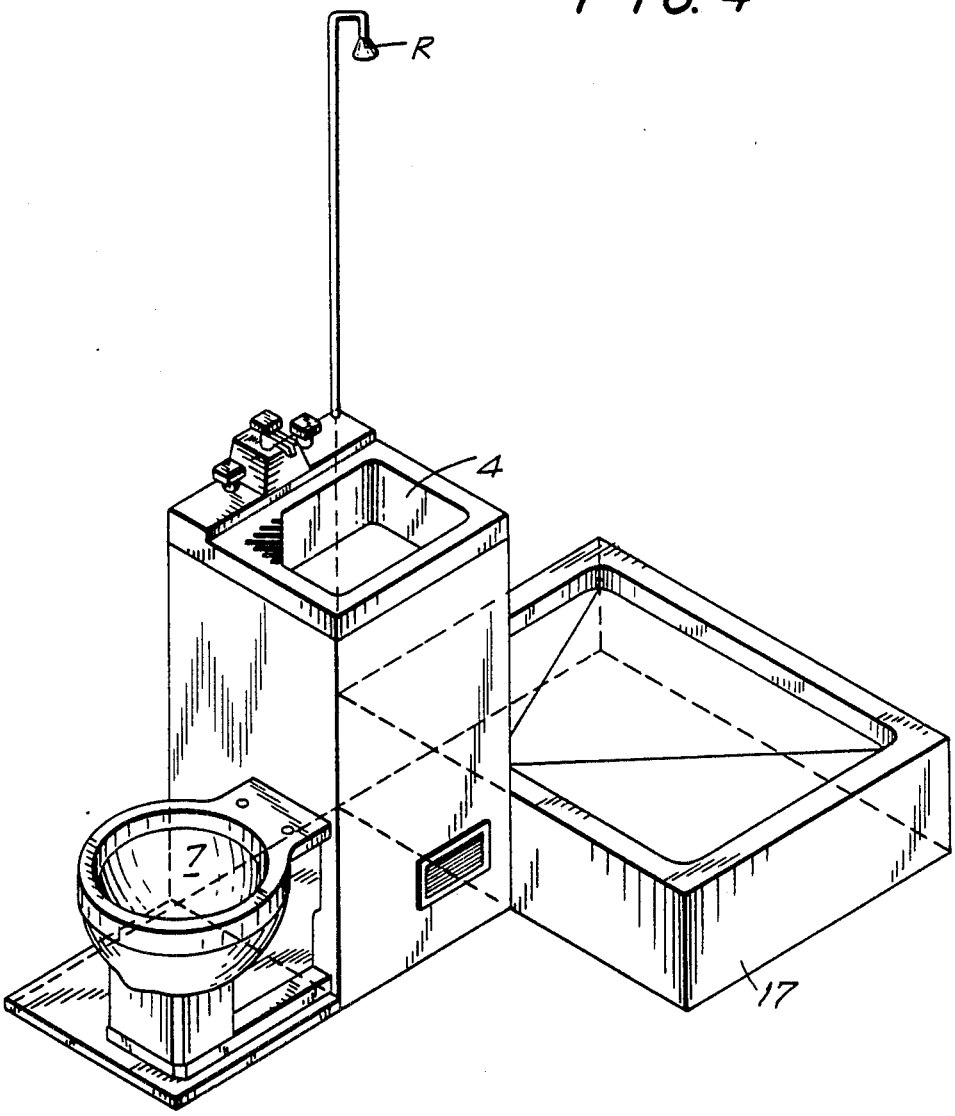
FIG. 4 is a conventional perspective view of same.

The modular bathroom can also be used simultaneously in tandem, with two units on opposite sides of a common wall or separately, as indicated on FIG. 4. The unit includes a washbasin 4 (cold or hot or mixed water); a shower R for bathing the whole body (cold or hot or mixed water); a toilet 7, a water tank 17 and a washing machine, not shown.

The modular cabinet of this invention provides for the following features for maintenance, repair or extraction of lost objects. The washbasin 4 is designed to be liftable, turning on pins, which make it possible at any time to gain direct access to the hydraulic system, so that a repair or the recovery of objects that have passed into the water tank may be performed (FIG. 2).

On the other hand, a drainage outlet 24 is illustrated in FIG. 5, coming from a sink 25 is fed with cold or hot water originating from the connections 18 or 19, as illustrated in FIG. 6.

The modular cabinet of this invention is designed in order to have direct access to the drainage system and to the hydraulic system by three sections, which enables repairs and/or maintenance to be carried out most easily and appropriately at any given time.

On the other hand, in case leaks are present in the hydraulic system (FIG. 6), the water originating from said leaks is also taken advantage of, since it falls into the water tank 8.

I claim:

1. A modular bathroom unit of various features comprising:

(a) a hydraulic system for connecting to a hot water supply and a cold water supply and supplying the various fixtures with water there from;

(b) a drainage system for providing drainage from fixtures within the modular unit;

(c) means for regulating the hot water and cold water supplies to the fixtures;

(d) said fixtures including (i) at least one wash basin with a faucet unit; and drain; and (ii) toilet;

(e) water collection and storage means positioned below the washbasin for collecting and storing water draining from the washbasin, said water collection and storage means including:

(1) a tank;

(2) a partition separating the tank into a first section and a second section; said partition dimensioned and configured so as to permit overflow from said first section to said second section; and (3) a check valve automatically permitting flow from said second section to the first section in response to a pressure difference therebetween;

(f) means to drain said first section of said water collection and storage means into said toilet to flush said toilet; and (g) a base unit for containing said washbasin, toilet, water collection and storage means, hydraulic system and drainage system.

2. The modular bathroom unit according to claim 1 wherein:

(a) the hydraulic system has a single inlet connection for connecting the cold water supply; and, (b) a single hot water connection for connecting the hot water supply.

3. The modular bathroom unit according to claim 1 further including:

(a) sewage trapping means for trapping sewage, soapy water and clean water coming from the toilet.

4. The modular bathroom unit according to claim 1 further including:

(a) a shower unit contained within the base unit.

5. The modular bathroom unit according to claim 4 wherein:

(a) the drainage system also includes a system of entrapment of water coming from the shower with:

(i) cesspool;

(ii) double ventilation for the drainage system;

(iii) an access for unplugging drainage; and, (iv) a single outlet connection for the drainage system.

6. The modular bathroom unit according to claim 1, further including:

(a) means for connecting the hot water supply, cold water supply and drainage systems to a satelite unit.

7. The modular bathroom unit according to claim 1 wherein:

(a) said wash basin is positioned directly above said first section of said water collection and storage means and drains directly into said first section.

8. The modular bathroom unit according to claim 1 wherein:

(a) said hydraulic system is positioned over said water collection and storage means such that any leaks occurring in said system would leak into said water collection and storage means.

* * * * *